US005931601A

United States Patent [19]

Terada et al.

[11] Patent Number: 5,931,601

[45] Date of Patent: Aug. 3, 1999

[54] TUNNEL EXCAVATOR

[75] Inventors: Shinichi Terada; Yoshihito Minami; Toshihiro Yamazaki; Masaru Nakamura, all of Osaka, Japan

[73] Assignee: Komatsu Ltd., Tokyo, Japan

[21] Appl. No.: 08/913,525

[22] PCT Filed: Mar. 21, 1996

[86] PCT No.: PCT/JP96/00741

§ 371 Date: Sep. 19, 1997

§ 102(e) Date: Sep. 19, 1997

[87] PCT Pub. No.: WO96/29505

PCT Pub. Date: Sep. 26, 1996

[30] Foreign Application Priority Data

Mar. 22, 1995 [JP] Japan ..... 7-63114

[51] Int. Cl.[6] ..... E21D 1/06; E21D 3/00

[52] U.S. Cl. ..... 405/138; 175/53; 299/31; 405/142

[58] Field of Search ..... 405/138, 141, 405/145, 199, 142; 175/53, 98, 99, 385, 386, 391; 299/31

[56] References Cited

U.S. PATENT DOCUMENTS

| | | | |
|---|---|---|---|
| 4,270,618 | 6/1981 | Owens | 175/57 |
| 5,199,515 | 4/1993 | Sinclair et al. | 175/213 |
| 5,308,150 | 5/1994 | Whitehouse | 299/61 |
| 5,325,932 | 7/1994 | Anderson et al. | 175/325.3 |
| 5,429,198 | 7/1995 | Anderson et al. | 175/230 |

FOREIGN PATENT DOCUMENTS

| | | |
|---|---|---|
| 3-290595 | 12/1991 | Japan . |
| 5-125892 | 5/1993 | Japan . |
| 5-321579 | 12/1993 | Japan . |
| 6-42285 | 2/1994 | Japan . |
| 7-10098 | 2/1995 | Japan . |

OTHER PUBLICATIONS

International Preliminary Examination Report with Annexes, (PCT/JP 96/00741).

*Primary Examiner*—Tamara Graysay
*Assistant Examiner*—Tara L. Mayo
*Attorney, Agent, or Firm*—Armstrong, Westerman, Hattori, McLeland & Naughton

[57] ABSTRACT

A tunneling machine intended to stably carry out gripper replacement by restricting the load imposed on gripper jacks for the main gripper as much as possible during excavation of an inclined shaft. Such a tunneling machine comprises (1) a main beam that extends along a tunnel wall, (2) a nose gripper disposed in front of the main beam for gripping the main beam against the wall of a pilot shaft and a main gripper disposed behind the main beam for gripping the main beam against the wall of a reamed shaft, (3) a main frame supported by the main beam so as to be slidable back and forth and supporting a cutter head at the front portion thereof, (4) a holding gripper (composed of a roof support, side support, vertical support) for gripping the main frame against the wall of the reamed shaft, (5) thrust jacks coupling the main frame to gripper shoes for the main gripper, and (6) retaining jacks coupling the main frame to a carrier.

5 Claims, 8 Drawing Sheets

TUNNEL EXCAVATOR

TECHNICAL FIELD

The present invention relates to a tunneling machine particularly well suited for use in excavation of inclined shafts.

BACKGROUND

Generally, when constructing a tunnel of a large bore, a pilot shaft is first driven by a pilot tunneling machine and then reamed to a desired large bore by a reaming tunneling machine.

One known example of such a reaming tunneling machine is shown in FIG. 8. In this figure, a tunneling machine 101 comprises a main beam 104 that extends through a pilot shaft 102 and through a reamed shaft 103 and a main frame 106 that is supported by the main beam 104 so as to be slidable back and forth and supports a cutter head 105 at its front portion. Disposed in front of the main beam 104 is a nose gripper 107 for gripping the main beam 104 against the inner circumferential surface of the pilot shaft 102. Disposed behind the main beam 104 is a main gripper (rear gripper) 108 for gripping the main beam 104 against the inner circumferential surface of the reamed shaft 103. Gripper shoes 113 (see FIG. 9) for the main gripper 108 are coupled to the main frame 106 by means of a plurality of thrust jacks 109. The main frame 106 includes a holding gripper 110 for supporting the main frame 106 against the inner circumferential surface of the reamed shaft 103, upon and after completion of excavation.

Excavating/advancing operation by use of the tunneling machine 101 of the above-described structure is carried out in the following way.

In preparation for starting excavation, the main gripper 108 is extended under high pressure, the holding gripper 110 is held under reduced pressure, and after the nose gripper 107 is extended under high pressure, the holding gripper 110 is contracted. In this condition, excavation is carried out by rotating the cutter head 105 and extending the thrust jacks 109. After the main frame 106 is moved forward a distance corresponding to the stroke of the thrust jacks 109, the cutting head 105 is moved somewhat backwardly from the cutting edge and the rotation of the cutter head 105 is stopped to finish excavation. For gripper replacement, the holding gripper 110 is extended under high pressure, and after the nose gripper 107 is contracted, the main gripper 108 is contracted. After that, the thrust jacks 109 are contracted for thrust jack replacement and a cycle of excavating/advancing operation is thus completed. The cycle of excavating/advancing operation comprising a series of steps of: preparation for excavation; a start of excavation; completion of excavation; gripper replacement; and thrust jack replacement is repeated to drive a tunnel continuously.

As seen from FIG. 9, the main gripper 108 incorporated in the above-described type tunneling machine comprises a carrier 111 supported by the main beam 104, a gripper jack 112 supported by the carrier 111 and gripper shoes 113 supported on the forward end of the rod of the gripper jack 112 with the help of pins. For retaining the gripper jack 112 and the gripper shoes 113 within their specified pivotal ranges, jack retainers 115 each including a coil spring 114 therein are provided in front of and behind the gripper jack 112 respectively, and shoe retainers 117 each including a coil spring 116 therein are provided for the gripper shoes 13.

The tunneling machine having the above structure, however, reveals the following disadvantages during gripper replacement when it is used in excavation of an inclined shaft.

(1) When the main gripper 108 is contracted after the contraction of the nose gripper 107 for gripper replacement, the loads W of the main beam 104, the carrier 111 and a subsequent carriage coupled thereto are all imposed on the gripper jack 112 through the coil spring 114 of the jack retainer 115 positioned behind the gripper jack 112. For this reason, the coil springs 14 need strong force and should be small enough to be inserted between the carrier 111 and the gripper jack 112, and, in consequence, the carrier 111 which supports the coil springs 114 requires more strength to withstand the strong force of the coil springs 114.

(2) After the re-extension of the gripper jack 112 subsequent to gripper replacement, the loads W imposed on the gripper jack 112 continuously works on the coil spring 114 of the rear jack retainer 115 as a compression force and the coil spring 114 is never fled from the compression force during excavation. Accordingly, the spring force of the coil spring 114 is invariably exerted on the gripper jack 112, resulting in damage to the gripper jack 112.

(3) The loads W cause a moment M which allows the gripper shoes 113 to pivot such that their shoe faces confronting the shaft walls turn backward. Because of this moment M, the gripper shoes 113 are inclined so that the gripper shoes 113 cannot be stably pressed against the wall of the shaft.

The present invention has been made with the purpose of overcoming the foregoing problems and one of the objects of the invention is therefore to provide a tunneling machine that is capable of carrying out stable gripper replacement by restricting the loads exerted on the gripper jack for the main gripper as much as possible during the gripper replacement step in excavation of an inclined shaft.

DISCLOSURE OF THE INVENTION

The above object can be achieved by a tunneling machine for use in excavation of an inclined shaft according to the invention, the tunneling machine comprising: (1) a main beam that extends along a tunnel wall, (2) a nose gripper and a main gripper that are respectively disposed in front of and behind the main beam, for gripping the main beam against the tunnel wall, (3) a main frame supported by the main beam so as to be slidable back and forth and supporting a cutter head at the front portion thereof, (4) a holding gripper for gripping the main frame against the tunnel wall, and (5) thrust jacks coupling the main frame to gripper shoes for the main gripper, wherein the main frame is coupled, by means of retaining jacks, to a gripper support for supporting the main gripper on the main beam, and the retaining jacks are operated to retain the gripper support before contraction of the main gripper during gripper replacement.

According to the invention, when contracting the main gripper for gripper replacement after completion of excavation, the loads (weights) of the main beam, subsequent carriage and others coupled to the main beam are carried by the main frame through the retaining jacks. Accordingly, the loads are prevented from being imposed on the main gripper through the gripper support, so that damage to the main gripper and tilting of the gripper shoes for the main gripper can be prevented. This permits stable gripper replacement.

According to the invention, the retaining jacks are preferably hydraulic jacks.

The retaining jacks may be preferably operated to freely extend following the movement of the thrust jacks during the extension of the thrust jacks. In addition, it is preferable that the thrust jacks be contracted simultaneously with the contraction of the retaining jacks.

It is desirable to use the tunneling machine of the invention in shaft sinking during which the loads imposed on the gripper jacks are particularly heavy, or in shaft raising.

Other objects of the present invention will become apparent from the detailed description given hereinafter. However, it should be understood that the detailed description and specific example, while indicating preferred embodiment of the invention, are given by way of illustration only, since various changes and modifications within the spirit and scope of the invention will become apparent to those skilled in the art from this detailed description.

BEST MODE FOR CARRYING OUT THE INVENTION

Figure 1:
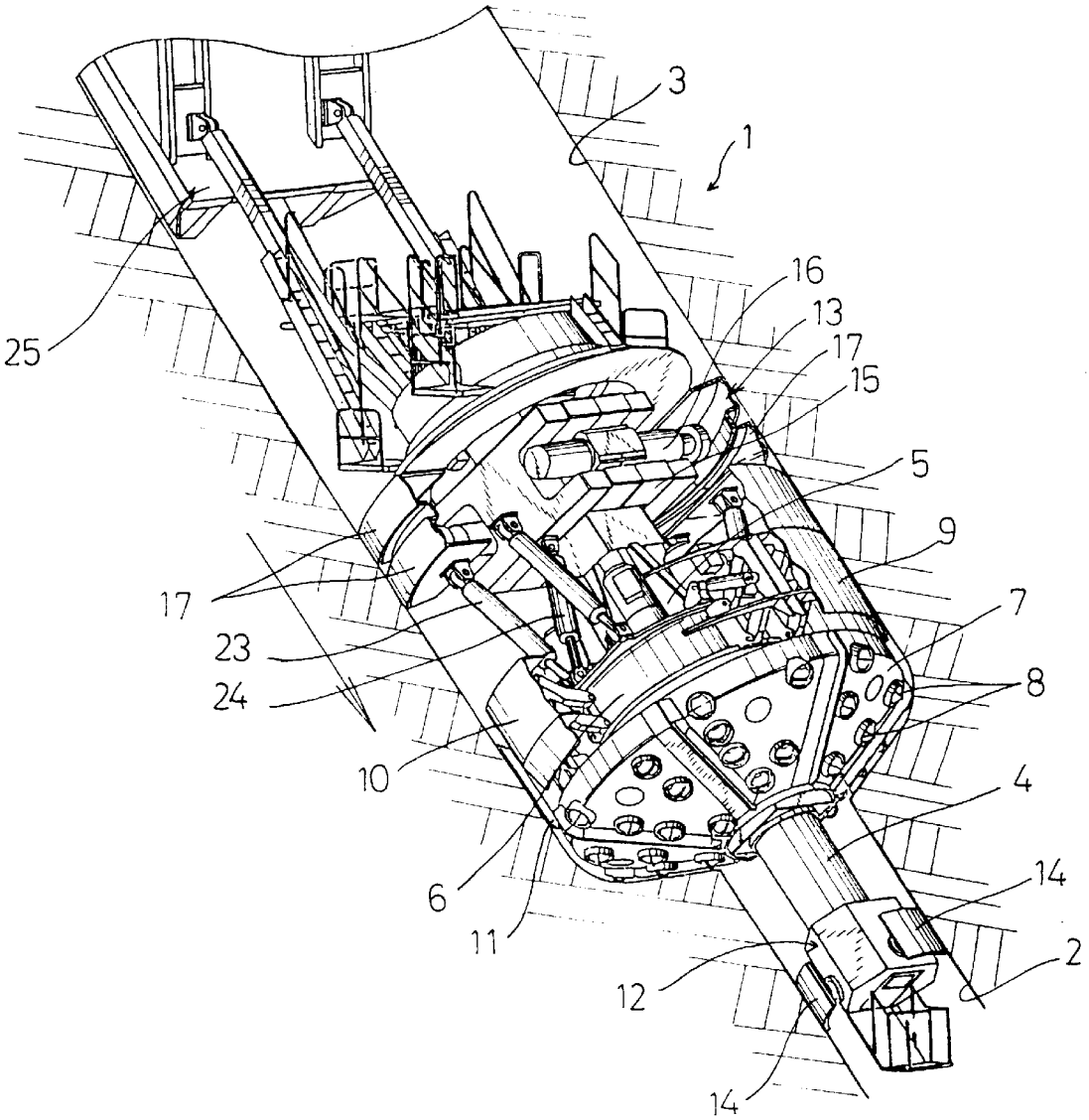
FIG. 1 is a diagrammatic perspective view showing the overall construction of a tunneling machine according to one embodiment of the invention.

Referring now to the drawings, a preferred embodiment of a tunneling machine according to the invention will be described below.

FIG. 1 shows a perspective view of the overall construction of a tunneling machine 1 according to one embodiment of the invention. The tunneling machine 1 of this embodiment is intended for use in excavating, for example, inclined shafts to build head races for electric power stations. Specifically, the tunneling machine 1 is a reaming tunneling machine designed to ream the natural ground left on the periphery of an inclined pilot shaft 2 to construct a reamed shaft 3, subsequently to excavation of the pilot shaft 2 by a pilot tunneling machine.

The tunneling machine 1 includes a main beam 4 extending through a pilot shaft 2 and through a reamed shaft 3 and having a cylindrical section at its front portion and a prismatic section at its rear portion, and a main frame 5 supported on the main beam 4 so as to be slidable back and forth. A cutter head 7 is freely rotatably supported on the main frame 5 by means of a cutter head support 6. Mounted on the front end of the cutter head 7 are a number of roller cutters 8. To hold the main frame 5 against the inner circumferential surface of the reamed shaft 3 upon and after completion of excavation, the cutter head support 6 is provided with a holding gripper composed of a roof support 9, a side support 10 and a vertical support 11. The roof support 9, side support 10 and vertical support 11 are supported by the cutter head support 6 through links and held against the inner circumferential surface of the reamed shaft 3 by the operation of gripper jacks composed of hydraulic cylinders.

Provided ahead of the main beam 4 is a nose gripper 12 for gripping the main beam 4 against the inner circumferential surface of the pilot shaft 2. Provided on the back of the main beam 4 is a main gripper (rear gripper) 13 for gripping the main beam 4 against the inner circumferential surface of the reamed shaft 3. The nose gripper 12 includes three gripper jacks disposed at three positions into which the circumference of the nose gripper 12 is equally divided, and gripper shoes 14 each disposed at the forward end of each gripper jack. The main gripper 13 comprises a carrier (i.e., gripper support) 15 supported by the main beam 4, four gripper jacks 16 respectively supported by the upper and lower portions of the carrier 15, and gripper shoes 17 each of which is mounted on the forward end of the rod of each gripper jack 16 with a pin.

Figure 2:
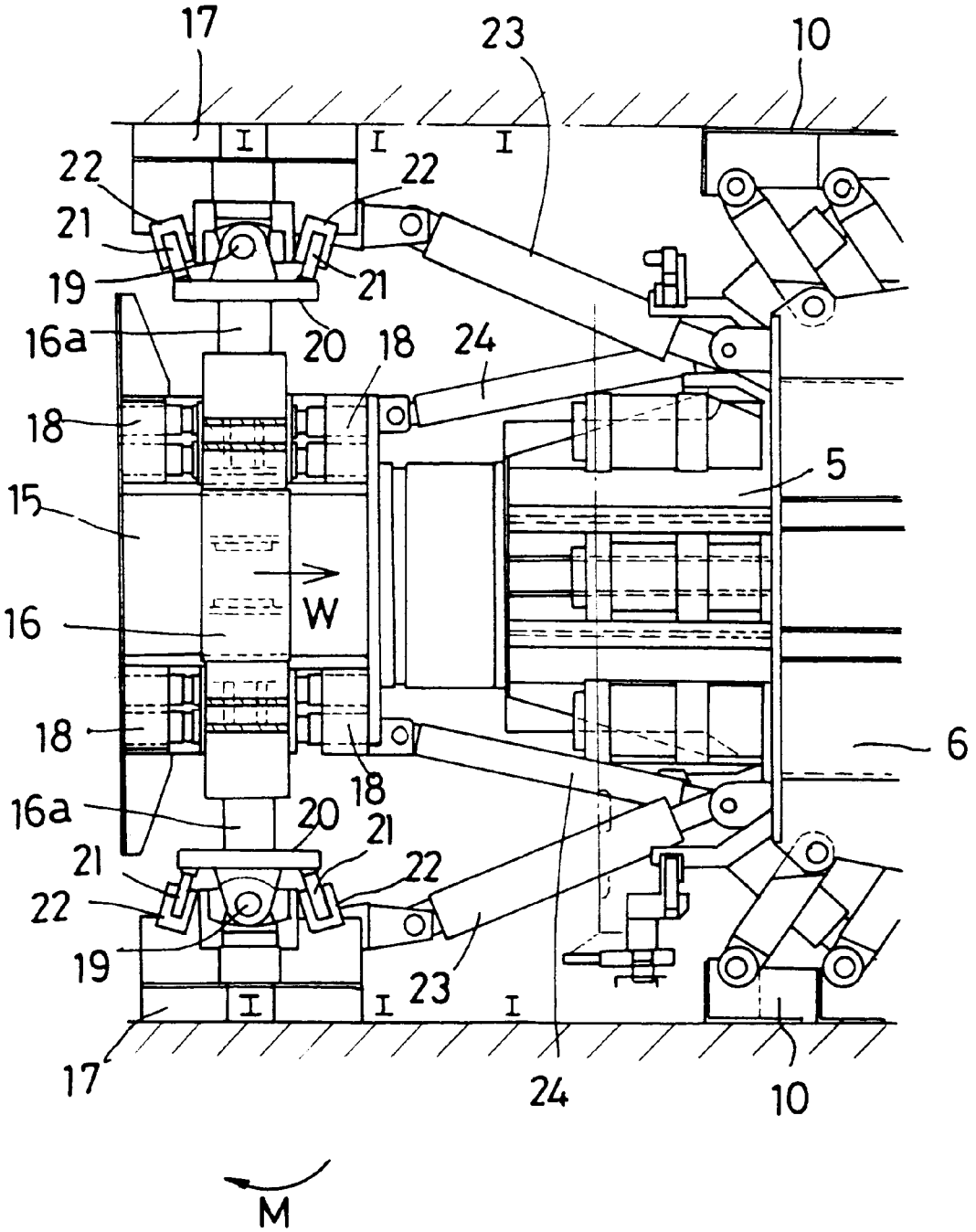
FIG. 2 is a partial top view of a main gripper incorporated in the tunneling machine according to the embodiment of the invention.
Figure 9:
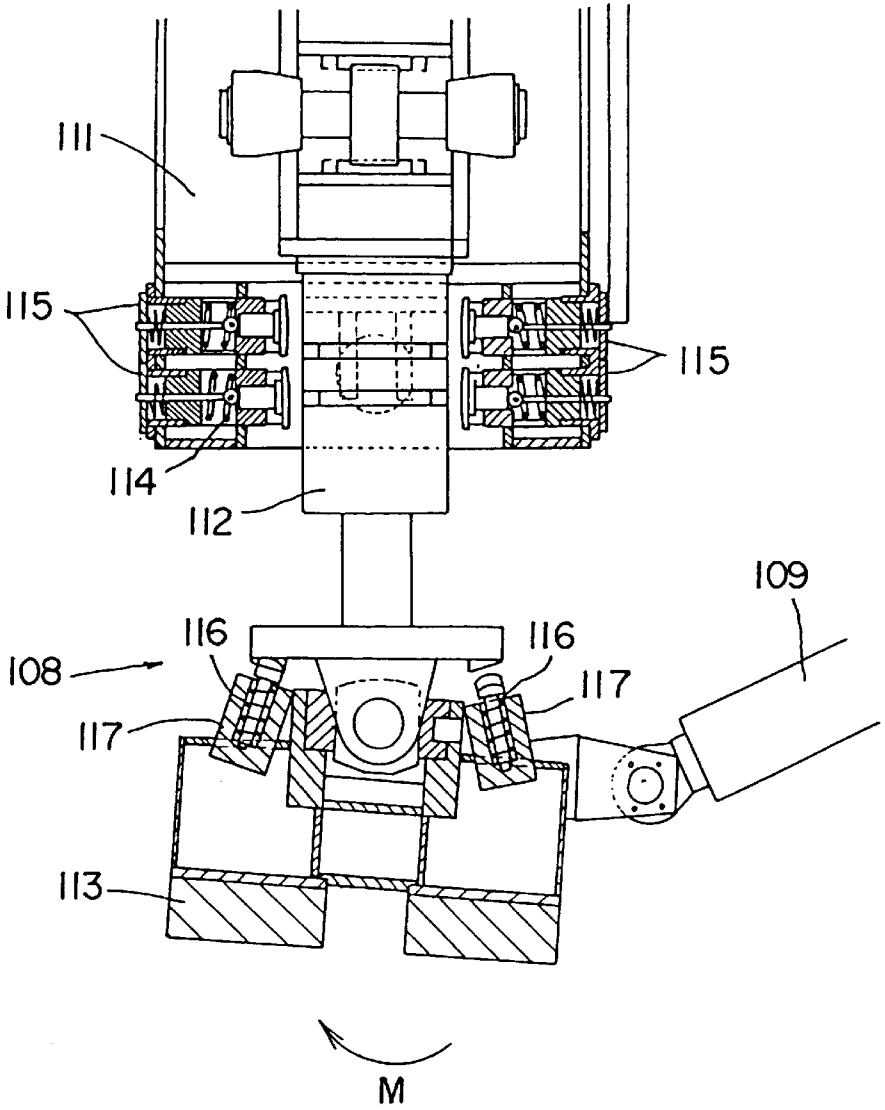
FIG. 9 PRIOR ART
FIG. 9 is a partial sectional view of a main gripper incorporated in the prior art tunneling machine for use in excavating a reamed shaft.

As seen from FIG. 2, the carrier 15 has a plurality of jack retainers 18 each of which sandwiches each gripper jack 16 so that each gripper jack 16 can be positioned within its specified pivotal range. The jack retainers 18 have a structure substantially similar to that of the prior art shown in FIG. 9 and are designed to hold gripper jacks 16 by utilizing the restoring force of coil springs which are housed in the respective jack retainers 18 and have been compressed at the time of displacement of the gripper jacks 16. The forward end of a rod 16*a* of each gripper jack 16 is provided with a supporting plate 20 which is disposed at an inner position than a pin supporting section 19. Shoe retainers 22 each having a coil spring 21 housed therein are provided on the side of each gripper shoe 17. Each gripper shoe 17 compresses the coil springs 21 of the corresponding shoe retainers 22 when pivoting about the pin supporting section 19 and is held at its predetermined position owing to the restoring force of the coil springs 21.

To generate a thrust force for the cutter head 7 during excavation, two right thrust jacks 23 and two left thrust jacks 23 are provided between the main gripper 13 and the main frame 5. The front end (rod end) of each left thrust jack 23 is coupled to the left side of the main frame 5 through a bracket, whereas the rear end of each left thrust jack 23 is coupled to the front end face of each left gripper shoe 17 through a bracket. The front end (rod end) of each right thrust jack 23 is coupled to the right side of the main frame 5 through a bracket whereas the rear end of each right thrust jack 23 is coupled to the front end face of each right gripper shoe 17 through a bracket.

Right and left hydraulic retaining jacks 24 are provided between the main frame 5 and the carrier 15. The front end (rod end) of the left retaining jack 24 is coupled to the left side of the main frame 5 through a bracket, whereas the rear end of the left retaining jack 24 is coupled to the left front end face of the carrier 15 through a bracket. The front end (rod end) of the right retaining jack 24 is coupled to the right side of the main frame 5 through a bracket, whereas the rear end of the right retaining jack 24 is coupled to the right front end face of the carrier 15 through a bracket. It should be noted that reference numeral 25 in FIG. 1 designates a subsequent carriage which is integrally coupled to the carrier 15.

Reference is made to FIGS. 3 to 7 to explain the excavating/advancing operation of the tunneling machine 1 constructed as described above.

Figure 3:
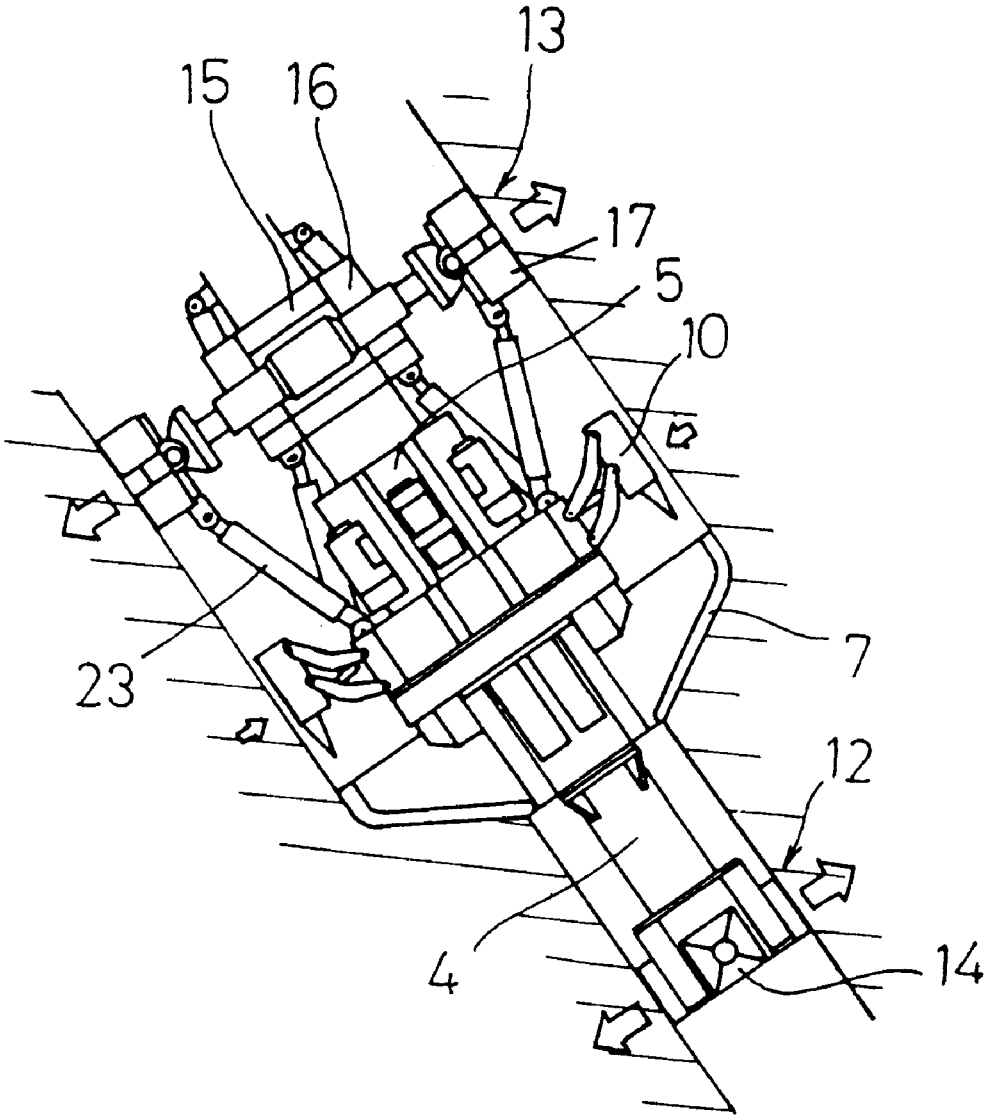
FIG. 3 is a diagrammatic view illustrating the excavating action (1) of the tunneling machine according to the embodiment.

(1) Preparation for Excavation (FIG. 3)

The main gripper 13 is extended under high pressure. The holding gripper (the roof support 9, side support 10 and vertical support 11) is maintained under reduced pressure. After the nose gripper 12 is extended under high pressure, the holding gripper is contracted.

Figure 4:
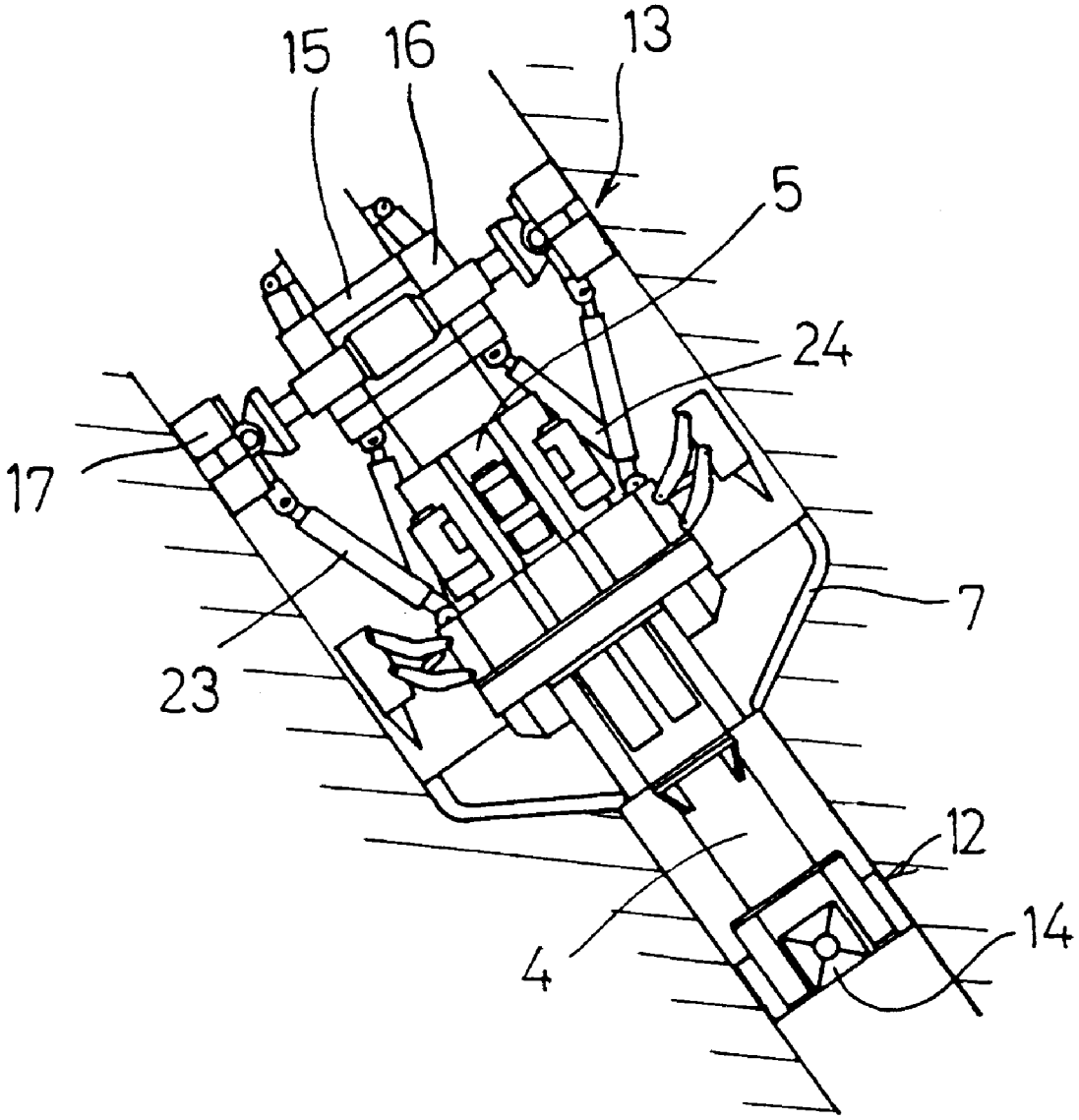
FIG. 4 is a diagrammatic view illustrating the excavating action (2) of the tunneling machine according to the embodiment.

(2) Start of Excavation (FIG. 4)

After the completion of the preparation for excavation, the cutter head 7 is rotated and the thrust jacks 23 are extended to perform excavation. The hydraulic circuit is designed such that during the extension of the thrust jacks 23, the retaining jacks 24 can extend freely following the movement of the thrust jacks 23.

Figure 5:
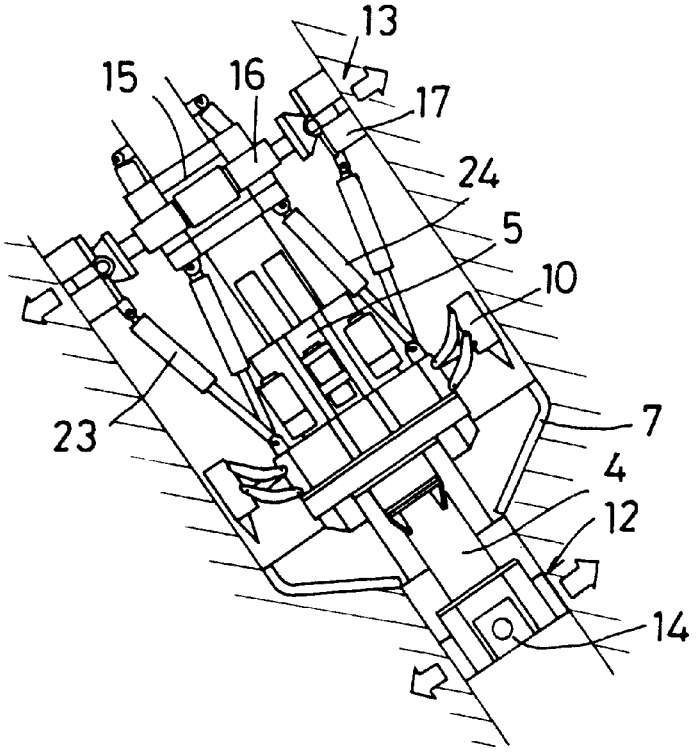
FIG. 5 is a diagrammatic view illustrating the excavating action (3) of the tunneling machine according to the embodiment.

(3) Completion of Excavation (FIG. 5)

After the main frame 5 has been moved forward a distance corresponding to the stroke of the thrust jacks 23, the cutter head 7 is moved somewhat backwardly from the cutting edge and the rotation of the cutter head 7 is stopped to finish the excavation.

Figure 6:
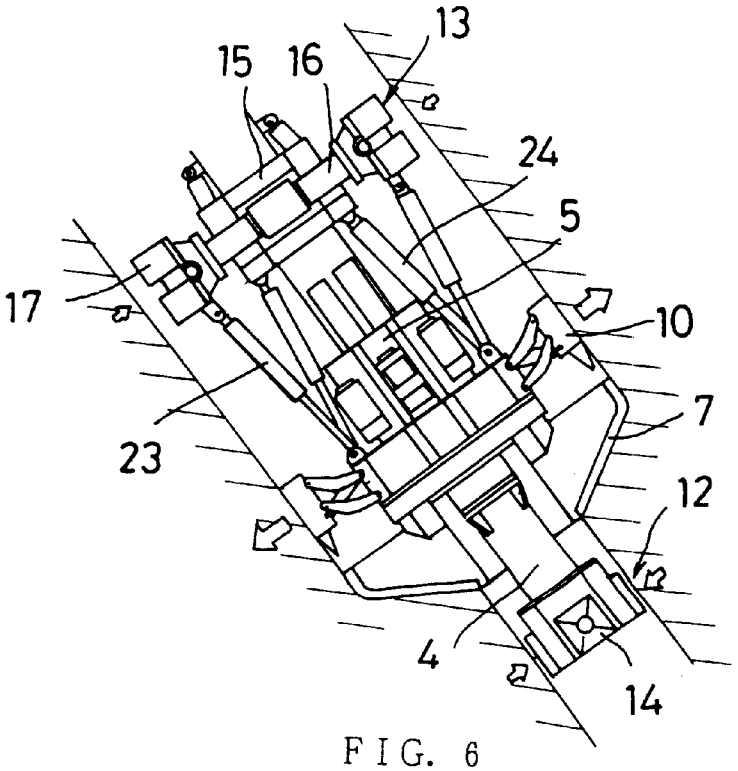
FIG. 6 is a diagrammatic view illustrating the excavating action (4) of the tunneling machine according to the embodiment.

(4) Resetting of Grippers (FIG. 6)

After the completion of the excavation, the holding gripper is extended under high pressure and after contracting the nose gripper 12, the main gripper 13 is contracted. In the mean time, hydraulic pressure is applied to the retaining jacks 24 simultaneously with the extension of the hold gripper under high pressure, and all the loads including the load of the carrier 15 are received by the retaining jacks 24 before the contraction of the main gripper 13.

Figure 7:
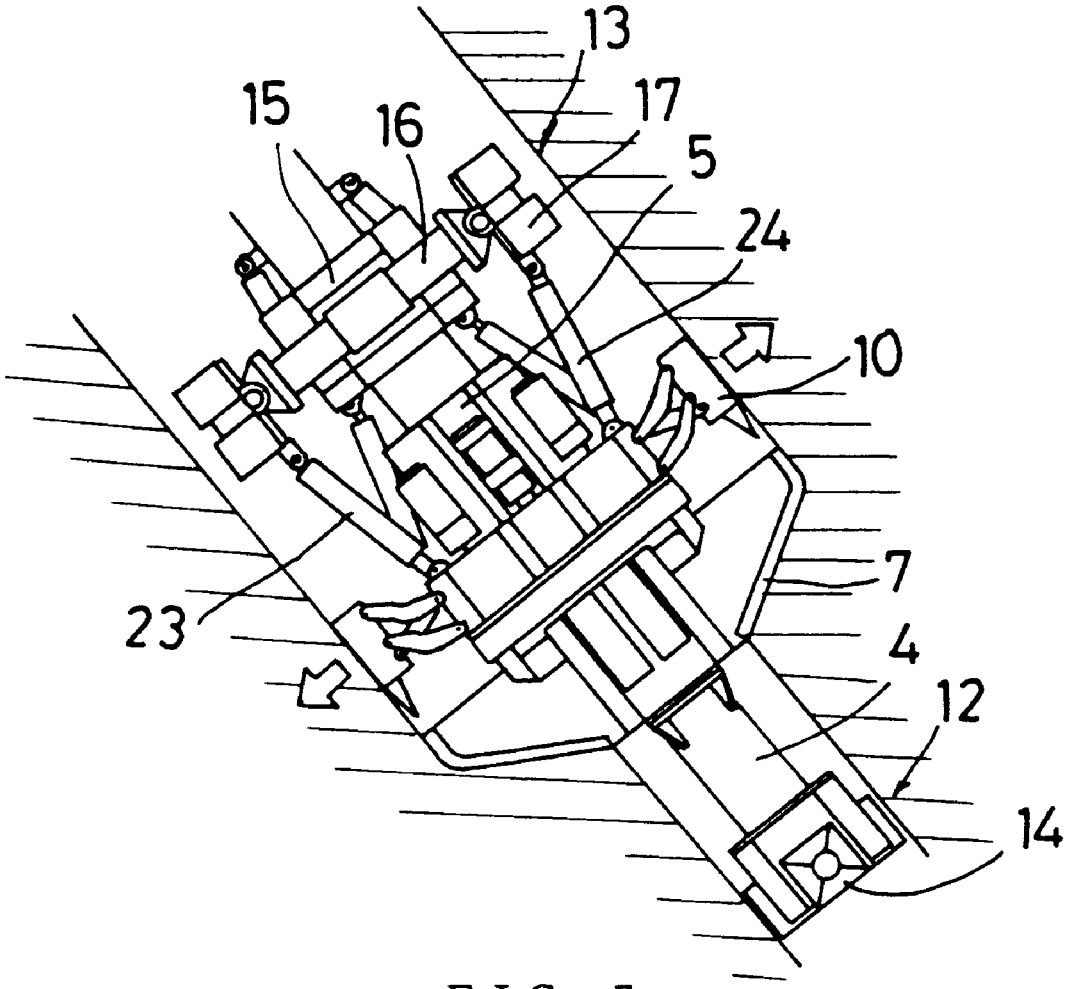
FIG. 7 is a diagrammatic view illustrating the excavating action (5) of the tunneling machine according to the embodiment.
Figure 8:
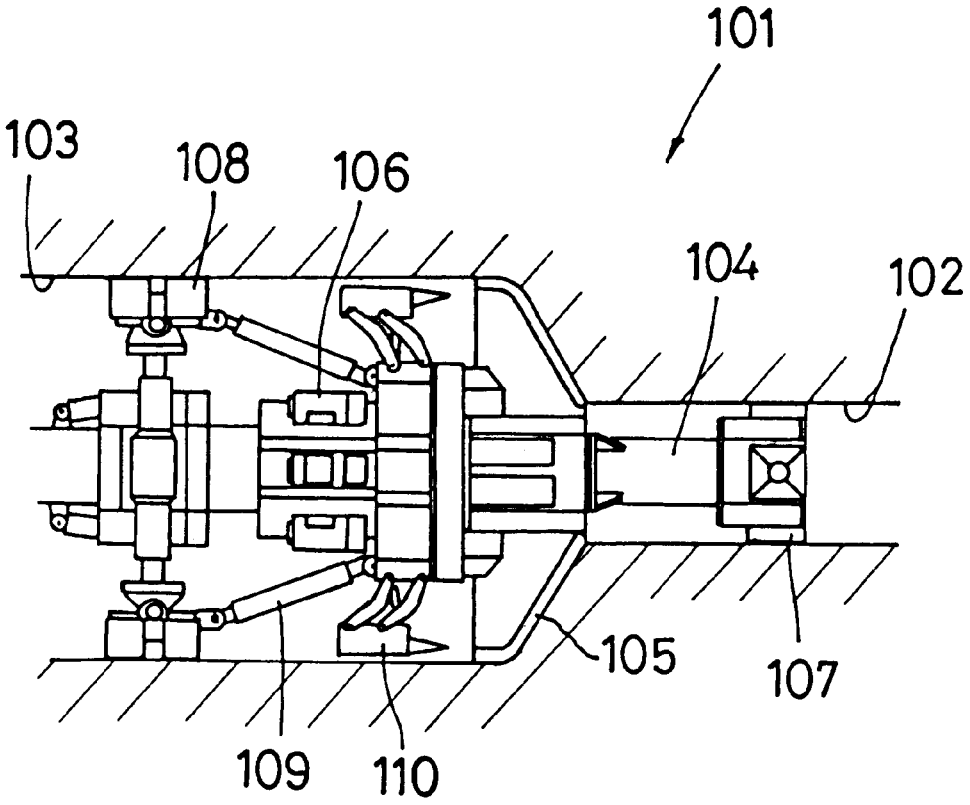
FIG. 8 PRIOR ART
FIG. 8 is a longitudinal sectional view of a prior art tunneling machine for use in excavating a reamed shaft.

(5) Resetting of Thrust Jacks (FIG. 7)

The carrier 15 and other members are pulled toward the main frame 5 by contracting the retaining jacks 24. During the contraction of the retaining jacks 24, the thrust jacks 23 are pulled at the same time so that the thrust jacks 23 partially receive the loads of the carrier 15 and others. It should be noted that the hydraulic circuit may be designed such that the thrust jacks 23 are brought into a free condition at the time of the contraction of the retaining jacks 24.

The above-described steps (1) to (5) constitute a cycle of excavating/advancing operation and this cycle is repeatedly performed thereby proceeding the construction of the reamed shaft 3.

According to the invention, the load imposed on the coil springs housed in the jack retainers 18 during gripper replacement is only the weights of the gripper jacks 16 and the gripper shoes 17, so that the moment M, which pivots the gripper shoes 17 such that their shoe faces confronting the tunnel wall to turn backward, will not increase. Accordingly, small-size coil springs can be employed as the coil springs housed in the jack retainers 18 and the coil springs 21 housed in the shoe retainers 22 and stable gripper replacement can be achieved.

While this embodiment employs hydraulic jacks as the retaining jacks 24, screwed jacks operated by controlling a motor may be used.

While this embodiment has been described with a case where an inclined shaft is excavated downwardly (shaft sinking), the inventive arrangement including the retaining jacks is also useful in cases where an inclined shaft is upwardly excavated (shaft raising).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tunneling machine for use in excavation of an inclined shaft, comprising: a main beam that extends along a tunnel wall, a nose gripper and a main gripper that are respectively disposed in front of and behind the main beam, for gripping the main beam against the tunnel wall, a main frame supported by the main beam so as to be slidable back and forth and supporting a cutter head at the front portion thereof, a holding gripper for gripping the main frame against the tunnel wall, and thrust jacks coupling the main frame to gripper shoes for the main gripper, wherein the main frame is coupled, by means of retaining jacks, to a gripper support for supporting the main gripper on the main beam, and the retaining jacks are operated to retain the gripper support before contraction of the main gripper during gripper replacement.

2. A tunneling machine according to claim 1, wherein said retaining jacks are hydraulic jacks.

3. A tunneling machine according to claim 1, wherein said retaining jacks are operated to freely extend following the movement of said thrust jacks during extension of said thrust jacks.

4. A tunneling machine according to claim 1, wherein said thrust jacks are operated to be contracted at the same time that said retaining jacks are contracted.

5. A tunneling machine according to claim 1, 2, 3 or 4 which can be used in shaft sinking or shaft raising.

* * * * *